US005480241A

United States Patent [19]

Tietz

[11] Patent Number: 5,480,241

[45] Date of Patent: Jan. 2, 1996 t,

[54] TYPE DISK

[75] Inventor: Gerhard Tietz, Berlin, Germany

[73] Assignee: Alfred Ransmayer & Albert Rodrian, Berlin, Germany

[21] Appl. No.: 326,549

[22] Filed: Oct. 20, 1994

[30] Foreign Application Priority Data

Nov. 12, 1993 [DE] Germany ..... 43 39 239.3

[51] Int. Cl.[6] ..... B41J 1/22

[52] U.S. Cl. ..... 400/144.2; 400/144; 400/175

[58] Field of Search ..... 400/144.2, 144.1, 400/143, 175, 144, 140, 139, 174, 144.3

[56] References Cited

U.S. PATENT DOCUMENTS

| | | | |
|---|---|---|---|
| 4,521,124 | 6/1985 | Moulin | 400/175 |
| 4,542,999 | 9/1985 | Bauer et al. | 400/175 |
| 4,576,494 | 3/1986 | Smith | 400/175 |
| 4,717,271 | 1/1988 | Bauer et al. | 400/175 |
| 5,106,214 | 4/1992 | Meisner | 400/144.2 |

*Primary Examiner*—Edgar S. Burr
*Assistant Examiner*—Anthony H. Nguyen
*Attorney, Agent, or Firm*—Mark P. Stone

[57] ABSTRACT

A type disk for a typewriter, having a hub which can be plugged over a drive shaft of the typewriter and a catch, which can be moved to or fro relative to the hub, and is carried by an outrigger connected integrally to the hub and capable of being deflected in the axial direction of the hub and can be engaged in a recess of a collar of a drive shaft for rotational position fixing of the type disk. A cut-out which is arranged in the surface portion of the type disk for the hub extends in the configuration of a circular arc in the hub plane substantially in a semi-circular arc, and the outrigger is configured as a circular arc-shaped bow, the course of which is congruent with that of the cut-out in the region of the cut-out, and can be accommodated in the cut-out, the catch being arranged in a peak region of the bow.

10 Claims, 1 Drawing Sheet

TYPE DISK

BACKGROUND OF THE INVENTION invention relates to a type disk for a typewriter, having a hub which can be plugged over a drive shaft of the typewriter and a catch, which can be moved to and fro relative to the hub, is carried by an outrigger connected integrally to the hub and capable of sprung deflection in the axial direction of the hub and can be engaged in a recess of a collar of the drive shaft for rotational position fixing of the type disk.

U.S. Pat. No. 3,878,929 discloses a type disk of the type under consideration, having two outriggers which are used for fixing both the axial position and the rotational position of the type disk on the drive shaft of a typewriter. The outriggers are designed essentially in a T-shape, viewed in the direction of the type disk plane, the longitudinal bar of the T being arranged in the plane, the transverse bar of the T, on the other hand, perpendicular to the plane of the type disk. Because of the selected design of the outriggers, by pressing together the one end of the transverse bar, a spreading movement can be induced in its other end which allows hook-shaped catches arranged on the spreadable planes of the transverse beams to be brought into and out of engagement with locking grooves on the periphery of a flange of the drive shaft. The known solution is not able to be totally satisfactory, in that the outriggers project comparatively far over both sides of the type disk.

In another type disk disclosed by DE-OS 40 01 080, the axial position fixing is carried out by means of crescent-shaped outriggers oriented parallel to the type disk plane, which lock, with their free ends, in an annular groove in the region of the end of the drive shaft, while a spigot engaging in a recess and oriented parallel to the axis of rotation serves for rotational fixing, as is disclosed in CH-PS 668 039.

SUMMARY OF THE INVENTION

It is the object of the invention to equip a type disk of the generic type with a rotational position fixing independent of its axial position fixing in such a way that it enables a flat construction without impairment of the stiffness of the rotational position fixing. This object is achieved according to the invention in that a cutout is arranged in the surface part of the type disk allocated to the hub, extending in the shape of a circular arc in the hub plane over an approximately semicircular arc, in that the outrigger is configured as a circular arc-shaped bow, the course of which is congruent with that of the cutout in the region of the cutout, and can be accommodated by the latter, the catch being arranged in the peak region of the bow.

BRIEF DESCRIPTION OF DRAWINGS

Further details and features of the invention emerge from the subclaims and the appended drawing of a particularly advantageous embodiment of a type disk, described below.

DESCRIPTION OF THE BEST MODES FOR CARRYING OUT THE INVENTION

Figure 1:
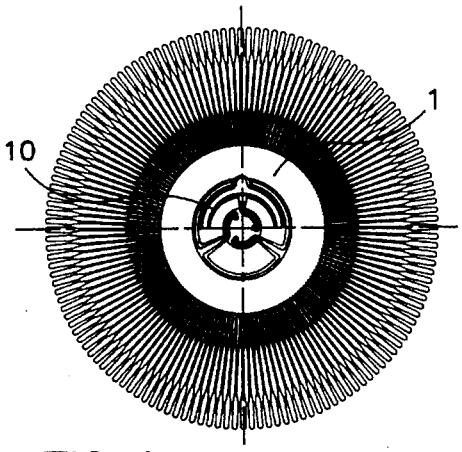
FIG. 1 shows the top view of a type disk.
Figure 2:
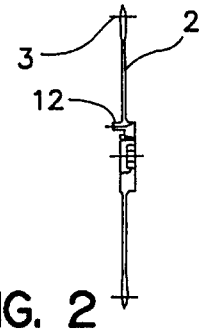
FIG. 2 shows a section through the type disk according to FIG. 1.

In the figures, 1 is the hub of a type disk, from which resilient spokes 2 extend outward, which carry type 3 on their free ends. The hub 1 has a central hole 4 for receiving the end of the drive shaft 5 of a typewriter, arcuate sprung webs 6 being used for securing the type disk on the drive shaft 5 and being provided at their ends with engaging lugs 7 which can engage in an annular groove 8 of the drive shaft 5.

Arranged concentrically to the hole 4 of the hub 1, there is a semicircular arc-shaped cutout 9, into which parts of a resilient outrigger 10, designed as an essentially semicircular bow, can penetrate, the said outrigger forming one piece with the hub 1, like the webs 6, and enabling the production of the type disk by injection molding, that is to say in one operation.

Figure 7:
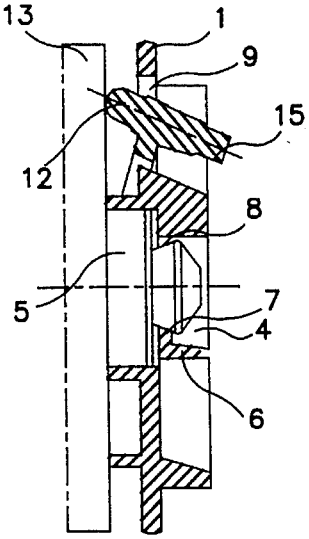

In the region of the peak 11 of the outrigger 10, the latter has a catch 12 formed by a projection. The catch 12, when the type disk is set on the drive shaft 5, presses uniformly against the front side either of a flange connected in a fixed manner to the drive shaft 5 or of a collar 13 forming one piece with the drive shaft 5 and provided with a recess 14. The catch 12 is pressed into the recess 14 by the outrigger 10, designed as a spring, as soon as the drive shaft 5 carries out a movement relative to the type disk and the recess 14 reaches a position in alignment with the catch 12. In order to ensure that the catch 12 engages in the recess 14 after only one rotation, in the modified embodiment indicated in FIG. 7, a projection 15 is arranged on the side of the outrigger 10 opposite the catch 12, the said projection, in the case of the catch 12 not being engaged in the recess 14 allocated to it, coming to rest against a stop on the machine side, not shown in the drawing, and consequently forming a rotational barrier, which prevents the type disk being carried along by the drive shaft 5 for more than one rotation as a result of a frictional lock.

Figure 3:
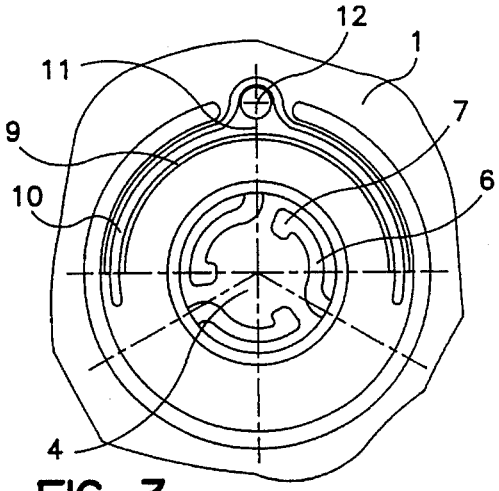
FIG. 3 shows, on an enlarged scale, the rear side, facing the drive shaft of a typewriter, of the hub of the type disk according to FIGS. 1 and 2.
Figure 4:
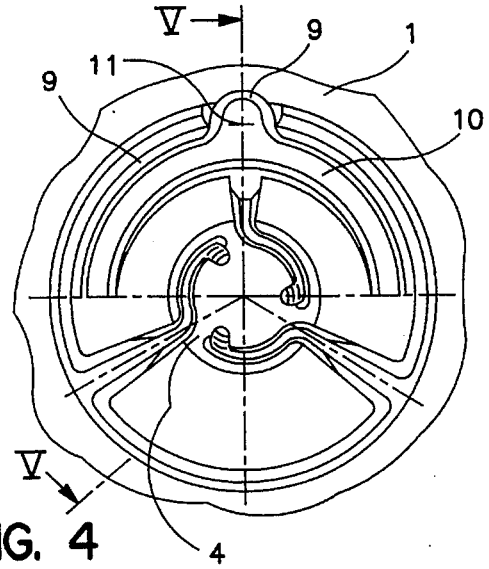
FIG. 4 shows the front side of the hub of the type disk according to FIGS. 1 and 2.
Figure 5:
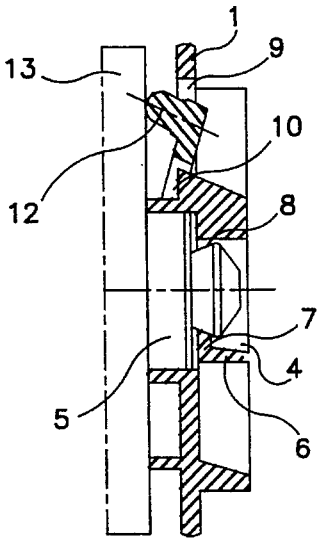
FIG. 5 shows a section along the line V—V in FIG. 4, in the so-called search position of the catch of the type disk.
Figure 6:
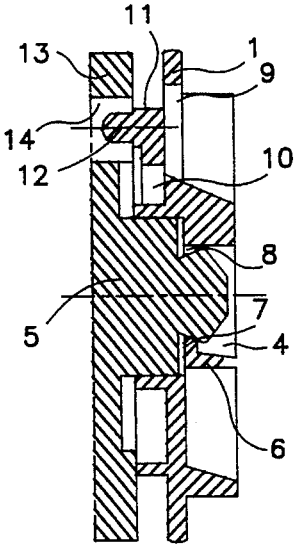
FIG. 6 shows a section corresponding to FIG. 5 in the writing position of the catch of the type disk and FIG. 7 shows a section corresponding to FIG. 5 through the hub of a slightly modified type disk.

As can be seen from both FIG. 3 and FIG. 6, the outrigger 10 is arranged offset by its thickness to the plane of the hub 1, and this is for reasons from injection molding technology.

I claim:

1. A type disk for a typewriter having a hub removably mounted on a drive shaft of the typewriter, the hub having a surface on which a cut out is arranged extending in the shape of a circular arc in the hub plane, a catch engageable with a recess of a collar of the drive shaft, an outrigger configured as a circular arc-shaped bow congruent to the cut out and connected integrally to the hub and having a peak region formed at the middle of the bow shape at which the catch is fixed, said peak region together with the catch being capable of spring deflection in the axial direction of the hub.

2. A type disk for a typewriter, as claimed in claim 1 wherein the cutout (9) and the outrigger (10) are designed essentially in a semicircular shape.

3. The type disk as claimed in claim 1, wherein the catch (12) is formed by a projection of the outrigger (10).

4. The type disk as claimed in claim 1, wherein the outrigger (10) is arranged axially offset to the hub plane.

5. The type disk as claimed in claim 1, wherein the outrigger (10) is provided with a projection (15) on its side opposite the catch (12), the said projection (15) forming a rotational blocking device for the type disk in the case of the catch (12) not being engaged in the recess (14) allocated to it.

6. The type disk as claimed in claim 1, wherein the disk is designed as an integral injection molding made of resilient plastic and has arcuate sprung webs (6) with engaging lugs (7) which can engage in an annular groove (8) of the drive shaft.

7. The type disk as claimed in claim 2, wherein the catch (12) is formed by a projection of the outrigger (10).

8. The type disk as claimed in claim 2, wherein the outrigger (10) is arranged axially offset to the hub plane.

9. The type disk as claimed in claim 3, wherein the outrigger (10) is arranged axially offset to the hub plane.

10. The type disk as claimed in claim 2, wherein the outrigger (10) is provided with a projection (15) on its side opposite the catch (12), the said projection (15) forming a rotational blocking device for the type disk in the case of the catch (12) not being engaged in the recess (14) allocated to it.

* * * * *